US008070027B2

(12) United States Patent
Piatt, Sr. et al.

(10) Patent No.: US 8,070,027 B2
(45) Date of Patent: Dec. 6, 2011

(54) ADAPTABLE TOOL HOOK

(76) Inventors: John A. Piatt, Sr., Haleiwa, HI (US); Richard S. Staken, II, Haleiwa, HI (US)

( * ) Notice: Subject to any disclaimer, the term of this patent is extended or adjusted under 35 U.S.C. 154(b) by 777 days.

(21) Appl. No.: 11/112,415

(22) Filed: Apr. 25, 2005

(65) Prior Publication Data

US 2006/0237498 A1 Oct. 26, 2006

(51) Int. Cl.
*A45F 5/00* (2006.01)

(52) U.S. Cl. ..... 224/269; 224/904; 224/250

(58) Field of Classification Search ..... 224/666, 224/250, 269, 271, 449, 560, 904, 901.4, 224/919, 581, 578, 667–670
See application file for complete search history.

(56) References Cited

U.S. PATENT DOCUMENTS

| | | | | | |
|---|---|---|---|---|---|
| 1,598,087 | A * | 8/1926 | Knight et al. | 24/348 |
| 3,022,898 | A * | 2/1962 | Loeb | 211/64 |
| 4,328,917 | A * | 5/1982 | Reeberg | 224/254 |
| 4,386,724 | A * | 6/1983 | Kotler | 224/255 |
| 4,628,893 | A * | 12/1986 | Shaw, III | 124/23.1 |
| 5,331,721 | A | 7/1994 | Raum, Sr. | 24/3.12 |
| 5,664,712 | A * | 9/1997 | Smrt | 224/250 |
| 5,738,080 | A * | 4/1998 | Brocco, Jr. | 124/86 |
| 5,788,132 | A * | 8/1998 | Kuruc, Jr. | 224/250 |
| 5,941,434 | A * | 8/1999 | Green | 224/250 |
| 5,979,851 | A * | 11/1999 | Purdy | 248/317 |
| 6,193,125 | B1 * | 2/2001 | Grover | 224/575 |
| 6,266,910 | B1 * | 7/2001 | Horine | 42/94 |
| D452,610 | S * | 1/2002 | Schwartzmiller | D3/228 |
| D469,250 | S * | 1/2003 | Armstrong | D3/228 |
| 6,641,011 | B1 * | 11/2003 | Kahn | 224/269 |
| 6,655,560 | B2 * | 12/2003 | Kahn | 224/268 |
| 6,994,238 | B2 | 2/2006 | Estabaya | 224/667 |
| 2004/0050888 | A1 * | 3/2004 | Warner | 224/269 |
| 2005/0011919 | A1 * | 1/2005 | Durham | 224/248 |
| 2006/0065684 | A1 * | 3/2006 | Houcek | 224/269 |
| 2006/0070761 | A1 * | 4/2006 | Vahabi-Nejad et al. | 173/217 |
| 2008/0000939 | A1 * | 1/2008 | Walsh | 224/269 |

* cited by examiner

*Primary Examiner* — Justin Larson
*Assistant Examiner* — Corey Skurdal
(74) *Attorney, Agent, or Firm* — Martin E. Hsia

(57) ABSTRACT

An adaptable-tool hook comprises a wire-frame buckle and hook with a strap. The strap can be positioned on the buckle-hook in two different orthogonal positions to allow the strap to wrap an object or tool laterally or longitudinally. The hook stays with the tool and can be hooked on any available belt, pocket, rail, or wire.

2 Claims, 4 Drawing Sheets

Fig. 5
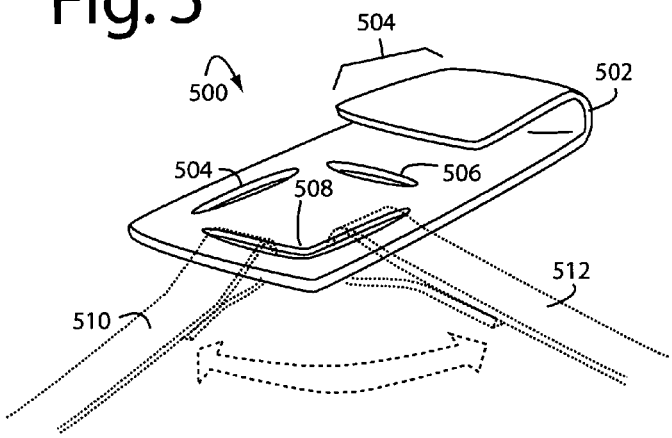
Fig. 8A
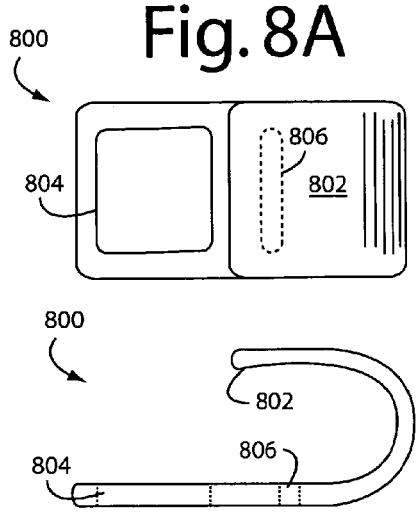
Fig. 8B
Fig. 6A
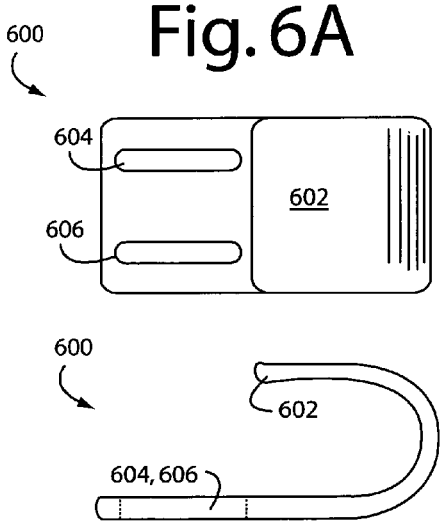
Fig. 6B
Fig. 7A
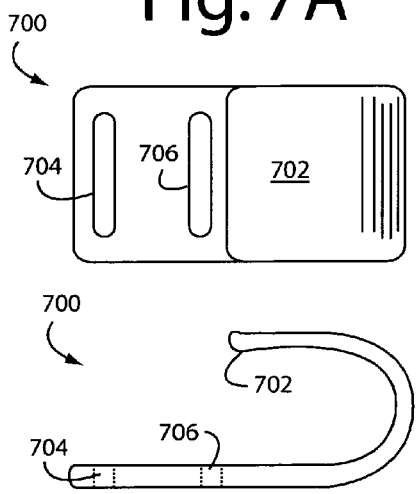
Fig. 7B

ADAPTABLE TOOL HOOK

BACKGROUND OF THE INVENTION

1. Field of the Invention

The present invention relates to hooks and hangers, and more particularly to hooks that can be quickly strapped to a hand tool and thereafter easily be hung from a belt or pocket of a worker.

2. Description of Related Art

Only having "two hands" often requires that a worker put down a hand tool in order to complete some procedure or prepare it for using the tool. But putting the tool down on the ground or table may not be possible or convenient. So a variety of workers tool pouches, holsters and hooks have been devised and marketed.

For example, a belt hook is shown by William Armstrong in U.S. Design Pat. No. D470,309 S, issued Feb. 18, 2003. Such appears to illustrate a saddle that can be threaded by a workers belt and worn on one side. A snap with a release lever allows a tool with a matching ring to be captured and held. Armstrong shows a variation of this idea in his U.S. Design Pat. No. D469,250 S, issued Jan. 28, 2003. Here a simple flat hook pointing upwards is strapped to a worker's belt.

James Schwartzmiller has a similar belt saddle with a low-slung hook that he illustrates in U.S. Design Pat. No. D452,610 S, issued Jan. 1, 2003. Such is being marketed under the trademark E-Z HOLSTER™. Web pages accessed from www.ezholster.com show how the belt saddle and hook are matched with a tool having a ring strapped to it with VELCRO strapping. The problem is the hook on the side of the worker can snag onto anything and can scratch and injure other people and objects. The tool can only be hung on the hook, and the hook must already be pre-attached to the worker's belt.

SUMMARY OF THE INVENTION

Briefly, an adaptable tool hook embodiment of the present invention comprises a wire-frame buckle and hook with a strap. The strap can be positioned on the buckle-hook in two different orthogonal positions to allow the strap to wrap an object or tool laterally or longitudinally. The hook stays with the tool and can be hooked on any available belt, pocket, rail, or wire.

An advantage of the present invention is a method and device are provided for hanging objects.

Another advantage of the present invention is that a method and device are provided that are simple, inexpensive, and effective.

A still further advantage of the present invention is that an adaptable hook is provided that can easily be strapped to a tool and then the tool can be hooked on a work-belt.

The above and still further objects, features, and advantages of the present invention will become apparent upon consideration of the following detailed description of specific embodiments thereof, especially when taken in conjunction with the accompanying drawings.

BRIEF DESCRIPTION OF THE DRAWINGS

FIG. 5 is a perspective diagram of another adaptable tool hook embodiment of the present invention that uses a sheetmetal plate hook base with two slots connected so a strap can be slipped between two orthogonal positions to increase the number of ways it can be used and the types of objects that can be attached to a hook;

FIGS. 6A, 6B, 7A, and 7B are side and top diagrams of adaptable tool hook embodiments of the present invention that each allow only one strap orientation. E.g., lateral for FIGS. 6A and 6B, and longitudinal for FIGS. 7A and 7B; and FIGS. 8A, and 8B are side and top diagrams of an adaptable tool hook embodiment of the present invention with one slot and one enlarged rectangular strap opening in a sheetmetal base that allows lateral and longitudinal strap orientations.

DETAILED DESCRIPTION OF THE INVENTION

Figure 1A:
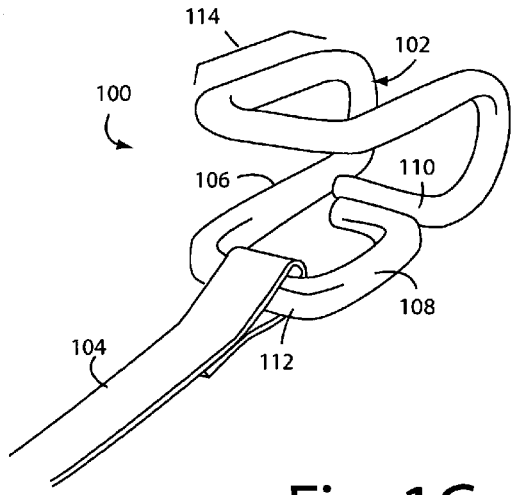
FIGS. 1A-1D are perspective diagrams of an adaptable tool hook embodiment of the present invention. These Figs. demonstrate how the strap can be slipped between two orthogonal positions to increase the number of ways it can be used and the types of objects that can be attached to a hook.

FIGS. 1A-1D illustrate an adaptable tool hook embodiment of the present invention, and is referred to herein by the general reference numeral 100. The adaptable tool hook 100 comprises a wire-frame buckle 102 and a strap 104. The buckle 102 has a left-lateral section 106, a right-lateral section 108, a top longitudinal section 110, and a bottom longitudinal section 112. These allow the strap 104 to be wrapped around an object with a hook section 114 being in-line or orthogonal.

Figure 1B:
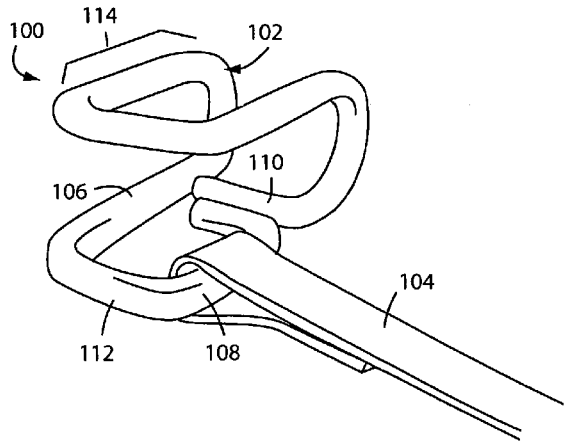
Figure 1C:
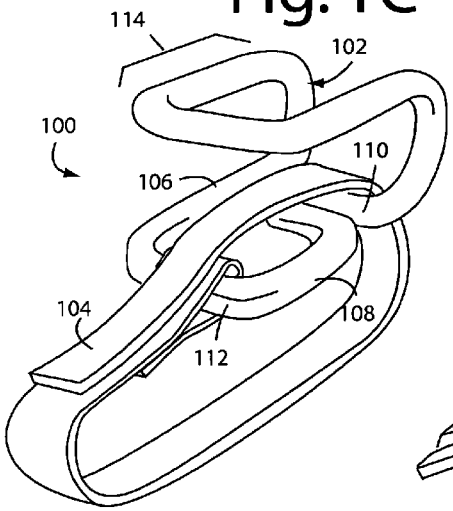
Figure 1D:
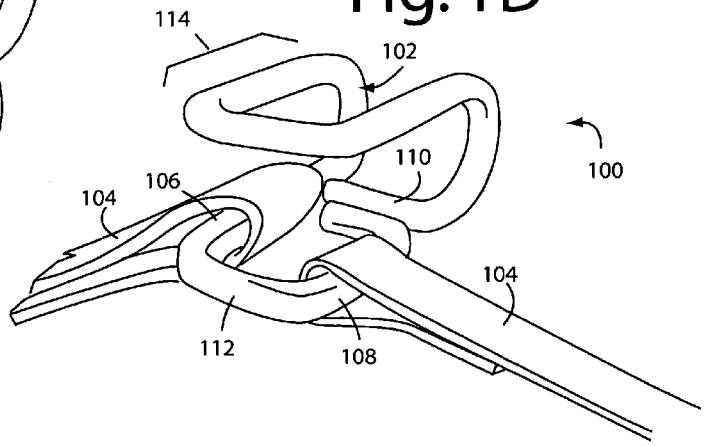

FIGS. 1A and 1C illustrate strap 104 in its longitudinal starting position on section 112. FIGS. 1B and 1D illustrate strap 104 in its lateral starting position on section 108. The two positions are orthogonal to one another. The wire-frame construction is key to allowing strap 104 to be slipped between sections 106-108-110-112. In FIG. 1C, strap 104 can be doubled back around section 110, similar to the way shown in FIG. 1D.

In use, the adaptable tool hook 100 can be strapped to any object the strap 104 can wrap around and the hook section 114 has the strength to support the weight. It need not necessarily be a tool, and it need not necessarily be hung on a worker or even a person. For example, the adaptable tool hook 100 could be wrapped around a stuffed toy and hung on a rail in a store for merchandising.

Figure 2B:
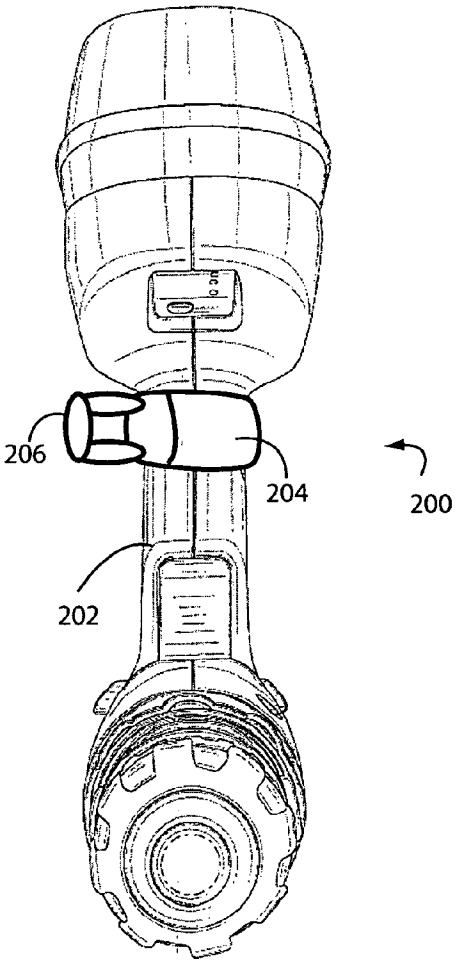
FIGS. 2A-2B are side and front view diagrams with a power hand tool fitted with the adaptable tool hook of FIGS. 1A-1D.
Figure 2A:
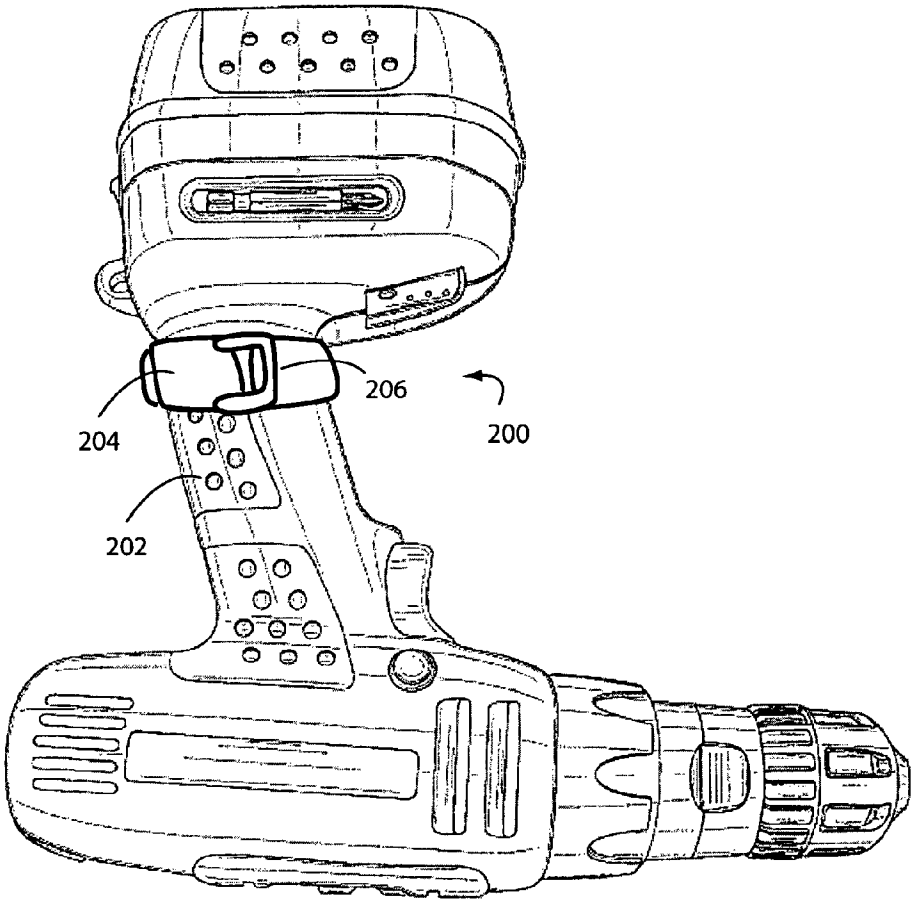

FIGS. 2A and 2B illustrate how an adaptable hook 200 can be used on a typical hand-tool tool 202. The adaptable hook 200 includes a VELCRO strap 204 attached to a wire-frame hook 206 wrapped around the pistol-grip of tool 202. This is shown with the strap 204 attached in the longitudinal position to wire-frame hook 206, and for a right-handed user that will use hook 206 on their waist belt. A user can then catch hook 206 in their belt or pocket when needing to free their hands.

Figure 3:
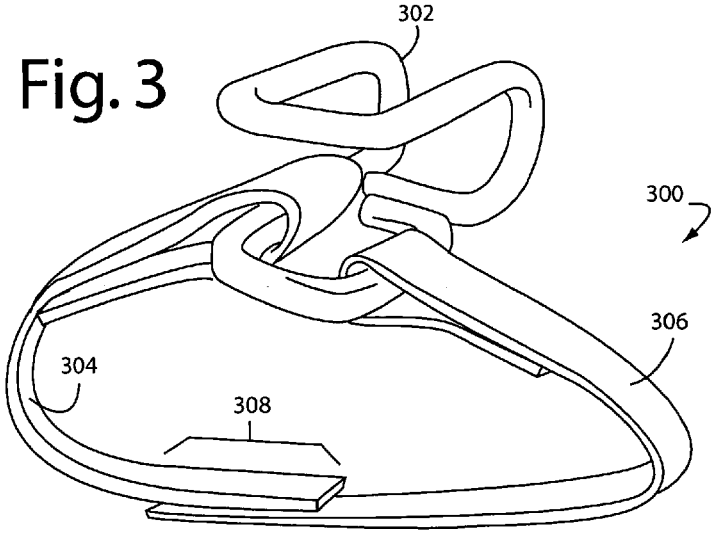
FIG. 3 is a perspective diagram of how an adaptable tool hook embodiment of the present invention can be fitted with two matching VELCRO straps.

FIG. 3 represents an adaptable tool hook embodiment of the present invention, and is referred to herein by the general reference numeral 300. The adaptable tool hook 300 comprises a hook-buckle 302, a VELCRO-hooks strap 304, a VELCRO-loops strap 306, and an area 308 in which the hooks can lock on to the loops to hold the tool.

When a single strap of VELCRO is used, it creates a challenge on how to thread the strap so the strap can wrap around the tool, hold the buckle 302, and still wind up with the VELCRO-hooks on one face able to engage the VELCRO-loops on the other face. A single simple VELCRO strap with hooks on one side and loops on the other could be used in FIGS. 1A-1D. In FIG. 3, adaptable tool hook 300 uses two separate straps.

Figure 4A:
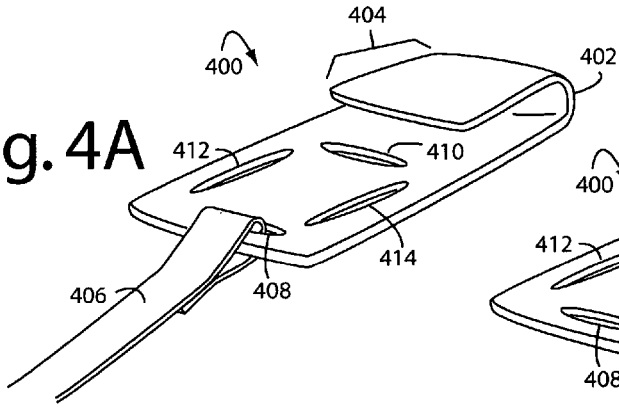
FIGS. 4A-4C are perspective diagrams of an alternative adaptable tool hook embodiment of the present invention that uses a sheetmetal plate hook base.
Figure 4B:
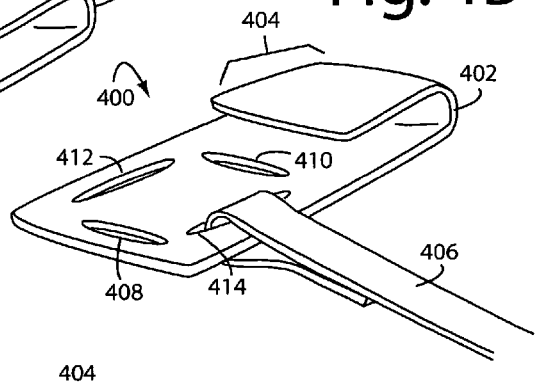
Figure 4C:
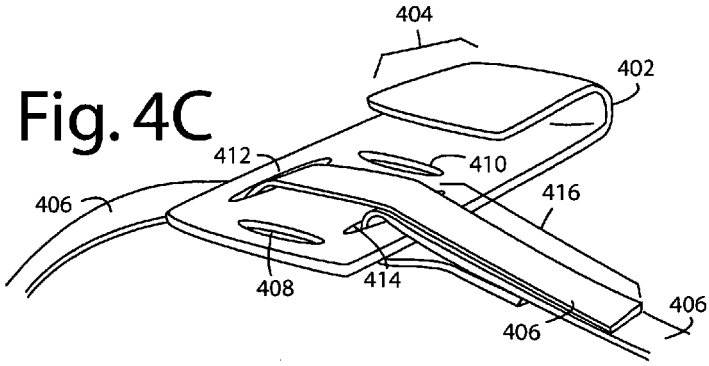

FIGS. 4A-4C demonstrate that embodiments of the present invention can be implemented in a number of ways, and do not depend on the use of wire-frames as illustrated in FIGS. 1A-1D, 2A-2B, and 3. In FIGS. 4A-4C, a sheetmetal hook adapter 400 comprises a hook base-plate 402 with a fold-over bend to form a flat belt hook 404. A strap 406 can be installed longitudinally (as shown) in a slot 408, or laterally in either of a pair of slots 412 and 414. If installed in slot 408, the strap 406 is wrapped around the tool or other object and threaded through slot 410 from underneath. The strap can be VELCRO, leather, metal, elastic, etc. Snaps, VELCRO, buckles, etc. can be used to secure it. FIG. 4B shows how strap 406 can be installed laterally in slot 414. In FIG. 4C it is shown how strap 406 can be returned through slot 412 and then secured in a VELCRO engagement area 416.

FIG. 5 represents another adaptable tool hook embodiment of the present invention, and is referred to herein by the general reference numeral 500. It uses a sheetmetal hook-base-plate 502 with a folded over flat hook 504. A lateral-strap slot 504 and a longitudinal-strap slot 506 are used in conjunction with a two-way slot 508. A strap 510 is shown in the longitudinal position and would be threaded back through slot 506. Such strap 510 can be slipped over in slot 508 to become a strap 512. Such is shown in the lateral position and would be threaded back through slot 504.

FIGS. 6A, 6B, represent a sheetmetal hook-base-plate 600 similar to those shown in FIGS. 4A-4C, and 5. It includes a folded over flat hook 602 and a pair of slots 604 and 606 for a lateral-only strap.

FIGS. 7A, 7B, represent a sheetmetal hook-base-plate 700 similar to those shown in FIGS. 4A-4C, and 5. It includes a folded over flat hook 702 and a pair of slots 704 and 706 for a longitudinal-only strap.

FIGS. 8A, 8B, represent a sheetmetal hook-base-plate 800 similar to those shown in FIGS. 4A-4C, and 5. It includes a folded over flat hook 802, a rectangular opening 804, and a slot 806 for anchoring a strap. The rim of rectangular opening 804 is such that a strap may be attached and slipped between longitudinal and lateral orientations.

Although particular embodiments of the present invention have been described and illustrated, such is not intended to limit the invention. Modifications and changes will no doubt become apparent to those skilled in the art, and it is intended that the invention only be limited by the scope of the appended claims.

The invention claimed is:

1. An adaptable hook for an object, comprising:

a buckle forming a hook, said buckle having a left lateral section spaced apart from a right lateral section, and a top longitudinal section spaced apart from a bottom longitudinal section, said lateral sections and said longitudinal sections forming a first side for contact with said object, a lateral anchoring position along one of said lateral sections and a longitudinal anchoring position along one of said longitudinal sections, said lateral anchoring position and said longitudinal anchoring position communicating with each other, for anchoring a strap in a choice of two orthogonal orientations; and a single strap that can be fastened to itself anchored near one end to a chosen one of said anchoring positions by slipping said strap between said anchoring positions for wrapping around and fastening said buckle to said object;

whereby said buckle can be placed with said first side in contact with said object and fastened to said object, by wrapping said single strap around said buckle and said object in one of two orthogonal orientations, and attaching said strap to itself;

whereby said object can be wrapped laterally or longitudinally;

wherein said buckle is a single-piece wire frame having two ends, and one of said sections is formed by the ends of said wire frame being substantially parallel and abutting each other.

2. An adaptable hook for an object, consisting of:

a single-piece wire frame buckle forming a hook, said buckle having a left lateral section spaced apart from a right lateral section, and a top longitudinal section spaced apart from a bottom longitudinal section, said lateral sections and said longitudinal sections forming a first side for contact with said object and two anchoring positions communicating with each other for anchoring a strap in a choice of two orthogonal orientations by slipping said strap between said anchoring positions;

wherein said wire frame has two ends and one of said sections is formed by said ends being substantially parallel and abutting each other; and a single strap that includes two pieces of hook-and-loop fasteners, with the hooks and loops of opposite pieces facing one another when said strap is wrapped around said buckle and said object, whereby said pieces can be fastened to each other by overlapping after said strap is wrapped around said buckle and said object;

whereby said buckle can be placed with said first side in contact with said object and fastened to said object by wrapping said single strap around said buckle and said object in one of two orthogonal orientations, and attaching said strap to itself;

whereby said object can be wrapped laterally or longitudinally.

* * * * *